US005511379A

United States Patent [19]

Gibot et al.

[11] Patent Number: 5,511,379

[45] Date of Patent: Apr. 30, 1996

[54] PROCESS FOR THE PRESERVATION OF PRODUCTS AT LOW TEMPERATURE IN AN INSULATED CHAMBER, INSTALLATION FOR PRACTICING THE PROCESS, INSULATED CHAMBER AND CONTAINER FOR SUCH A CHAMBER

[75] Inventors: Claude Gibot, Clichy Sous Bois; Philippe Bouguet, Fosses, both of France

[73] Assignee: Carboxyque Francaise, Puteaux, France

[21] Appl. No.: 285,718

[22] Filed: Aug. 4, 1994

[51] Int. Cl.[6] ..... F25D 3/12

[52] U.S. Cl. ..... 62/602; 62/54.3; 62/384

[58] Field of Search ..... 62/384, 388, 10, 62/54.3

[56] References Cited

U.S. PATENT DOCUMENTS

| | | | |
|---|---|---|---|
| 1,876,915 | 9/1932 | Gordon . | |
| 2,217,169 | 10/1940 | Hill . | |
| 2,316,423 | 4/1943 | Harvey et al. . | |
| 3,447,336 | 6/1939 | Gramse | 62/239 |
| 3,468,135 | 9/1969 | Doll et al. | 62/384 |
| 3,561,226 | 2/1971 | Rubin . | |
| 3,861,168 | 1/1975 | Sayers . | |
| 3,922,878 | 12/1975 | Jalali | 62/388 |
| 4,299,429 | 11/1981 | Franklin . | |
| 4,376,511 | 3/1983 | Franklin . | |
| 4,377,402 | 3/1983 | Crowe et al. . | |
| 4,415,346 | 11/1983 | Love . | |
| 4,502,293 | 3/1985 | Franklin . | |
| 4,704,876 | 11/1987 | Hill . | |
| 4,891,954 | 1/1990 | Thomsen | 62/239 |

FOREIGN PATENT DOCUMENTS

| | | |
|---|---|---|
| 0337860 | 10/1989 | European Pat. Off. . |
| 2534130 | 4/1984 | France . |
| 2604243 | 3/1988 | France . |
| 2257501 | 1/1993 | United Kingdom . |

*Primary Examiner*—Ronald C. Capossela
*Attorney, Agent, or Firm*—Young & Thompson

[57] ABSTRACT

An insulated chamber (1) for preservation and transportation comprises a container (2) of carbon dioxide snow provided with a lateral opening (5) permitting the injection, within the container, of liquid $CO_2$ under pressure by a distribution device (10) connected to a source of liquid $CO_2$ (6). The distribution device is provided with an electrovalve (18) controlled by a control block (19) comprising a timer permitting selecting the duration of injection of liquid $CO_2$ into the container (2) to form there a controlled volume of carbon dioxide snow. The installation is useful for the preservation and transportation of fresh food products as well as frozen food products.

9 Claims, 4 Drawing Sheets

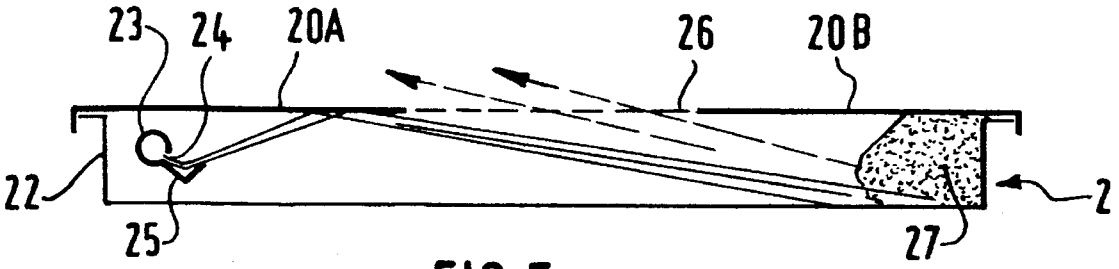
FIG.5
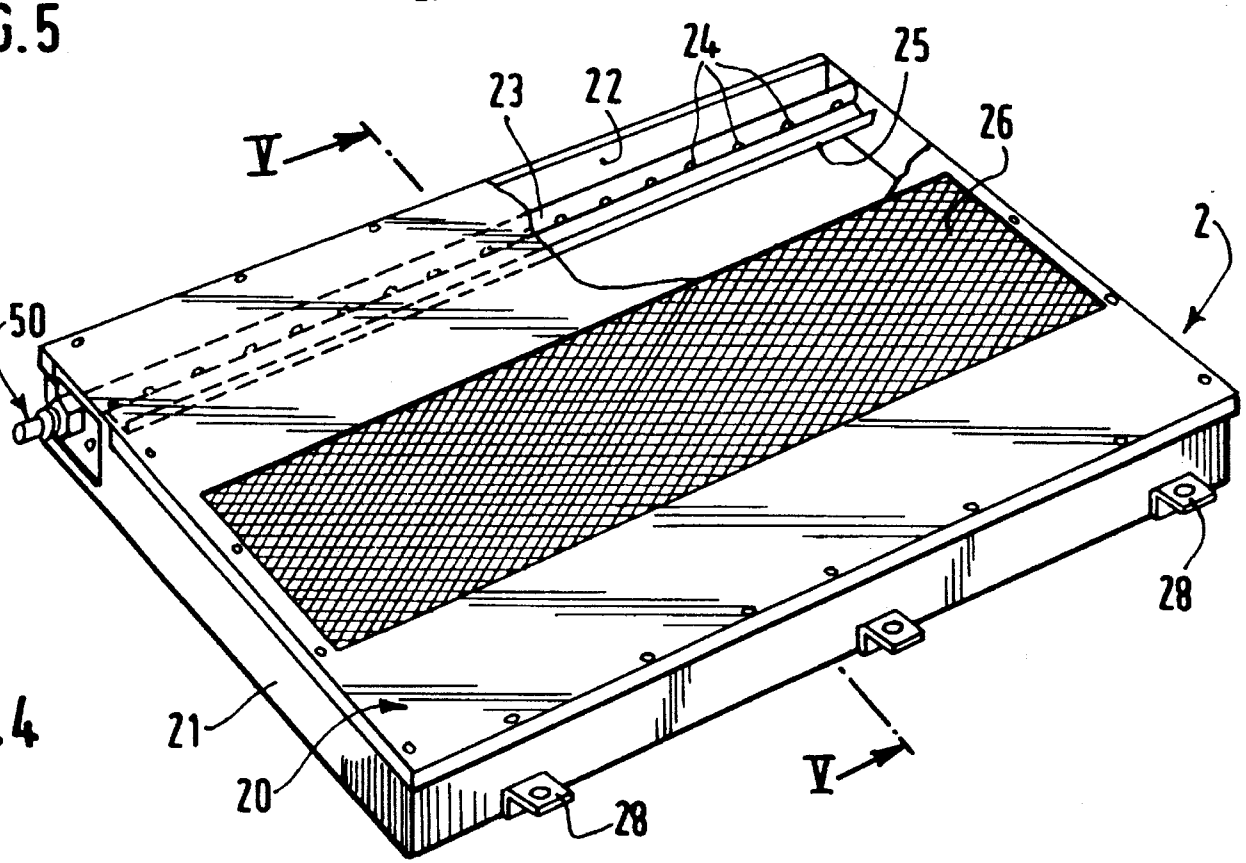
FIG.4
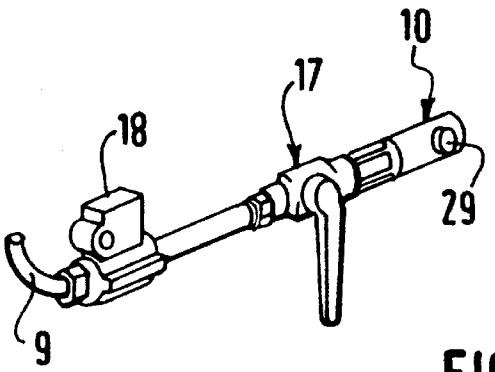

PROCESS FOR THE PRESERVATION OF PRODUCTS AT LOW TEMPERATURE IN AN INSULATED CHAMBER, INSTALLATION FOR PRACTICING THE PROCESS, INSULATED CHAMBER AND CONTAINER FOR SUCH A CHAMBER

FIELD OF THE INVENTION

The present invention relates to a process for the preservation at low temperature of products in a thermally insulated chamber comprising a load space and at least one receptacle of carbon dioxide snow.

BACKGROUND OF THE INVENTION

An insulated chamber of this type is described in EP-A-337.860, in the name of the applicant. At present, the receptacle is removable and comprises an upper open surface to receive the load of carbon dioxide snow from a container of carbon dioxide snow under vacuum or in the form of pellets. This type of manual loading is delicate, hardly controllable, gives rise to great losses of $CO_2$ and does not permit adapting the quantity of carbon dioxide snow to the precise needs for preservation of the particular products. This type of chamber is principally used for the preservation and transportation of frozen foodstuffs. For the transportation of fresh foodstuffs, such as hamburger steak or chicken, which do not tolerate too low temperatures, there is generally used an insulated chamber with no supply of carbon dioxide snow and preliminarily brought to the refrigeration temperature for storage of the products before their storage in the chamber and the transportation of the loaded chamber, which requires that the transportation time be reduced to the minimum.

SUMMARY OF THE INVENTION

The present invention has for its object to provide a process permitting a rapid, reliable and easily controlled loading of the container, even by unqualified personnel, requiring a minimum of manipulations, greatly reducing the losses of $CO_2$ and suitable for the preservation over long periods of fresh foodstuffs as well as for the preservation of frozen foodstuffs.

To do this, according to one characteristic of the invention, the process comprises the step of injecting into the container of the chamber a measured quantity of liquid $CO_2$ under pressure so as to create by expansion a predetermined mass of carbon dioxide snow.

According to other characteristics of the invention:

the controlled quantity of liquid $CO_2$ injected is determined as a function of the predetermined duration of injection, typically at least 10 seconds for fresh products and at least 20 seconds for frozen products, the duration of injection being preferably controlled, in a predetermined manner, as a function of the climatic or seasonal parameters.

The present invention also has for its object to provide an installation for practicing the process, comprising a source of liquid $CO_2$ under pressure and a supply conduit for liquid $CO_2$ connected to a distributor means for flow of liquid $CO_2$ into the container, the distributor means comprising a distribution valve connected to a control unit comprising adjustable timing means;

the distribution means is suspended from a framework carrying the control unit and preferably fixed to a housing provided with means for removal of gaseous $CO_2$ vaporized during injection of the flow of liquid $CO_2$ into the container;

the container is mounted fixedly in the chamber and comprises a lateral opening for charging $CO_2$, typically adapted to be paired with the distributor means.

The present invention also has for its object a container adapted for such an installation and an insulated chamber provided with such a container.

BRIEF DESCRIPTION OF THE DRAWINGS

Other characteristics and advantages of the present invention will become apparent from the following description of embodiments, given by way of illustration but in no way limiting, with respect to the accompanying drawings, in which:

FIG. 4 is a schematic perspective view, partially broken away, of a container according to a particular embodiment of the invention;

FIG. 5 is a transverse cross-sectional view, on the line V—V of FIG. 4, of the container according to the invention showing the path of the fluids in the chamber during loading of this latter;

DETAILED DESCRIPTION OF THE DRAWINGS

Figure 1:
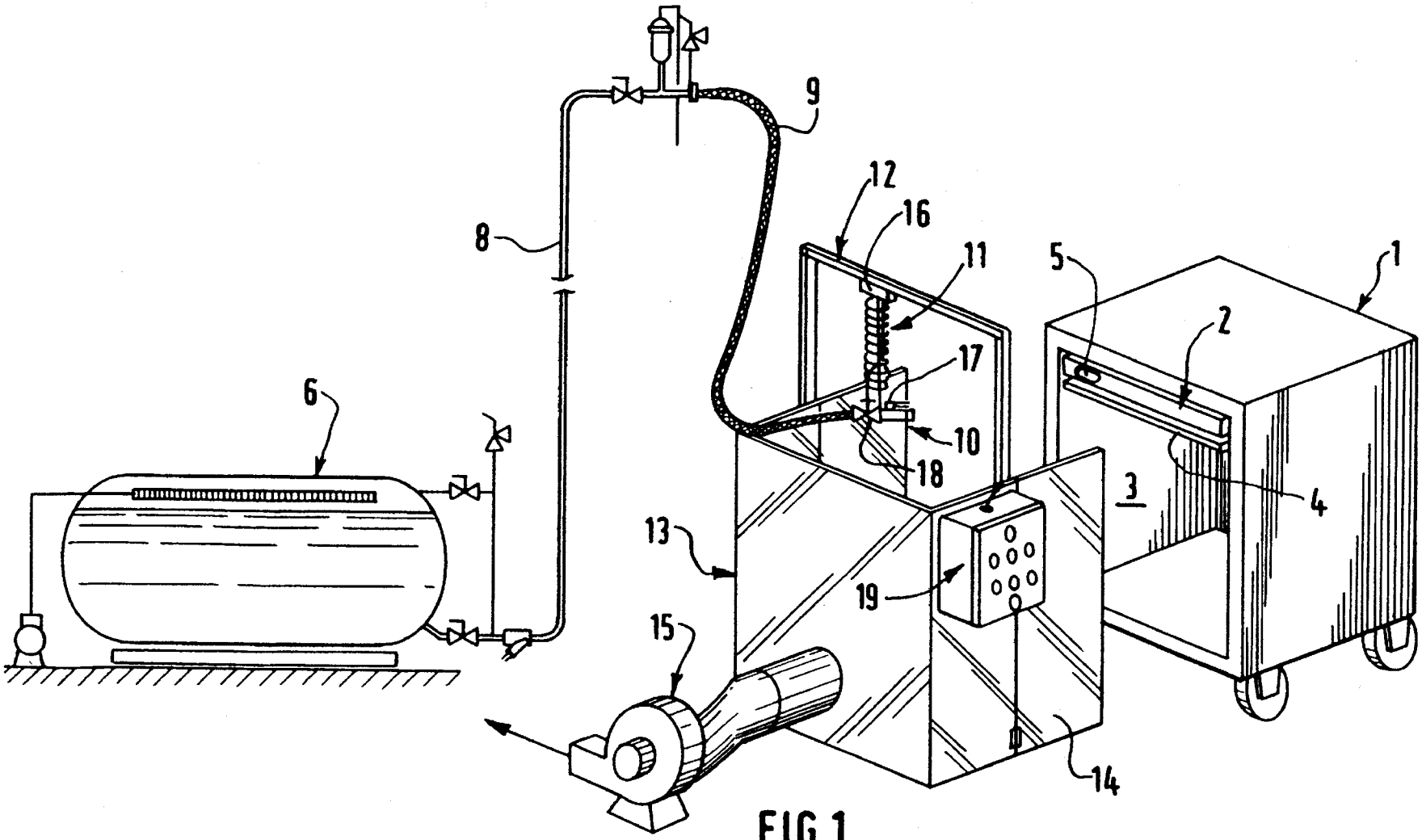
FIG. 1 is a schematic view of an embodiment of an installation according to the invention.

In FIG. 1, there is shown an insulated container 1 for the transportation of fresh products, as described in EP-A-337.860 mentioned above, the access door being omitted to show the container 2 for carbon dioxide snow suspended in the upper portion of the internal chamber of the container forming a volume 3 for loading of products. In FIG. 1, there is shown the thermal screen 4 extending at a distance from the internal surface of the container 2 and separating this latter from the loading volume 3 for the loading of fresh food products. According to one aspect of the invention, the container 2 is mounted fixedly in the container 1 and comprises, in the illustrated example, a forward surface provided with an opening 5 for access for loading the container with $CO_2$, as will be seen farther on.

The installation comprises, at a loading station, a reservoir 6 for liquid $CO_2$ at a pressure typically between 18 and $20\times10^5$ Pa and at a temperature of −20° C. maintained by a refrigeration means 7. From the reservoir 6 extends a supply conduit 8 for liquid $CO_2$ provided with suitable valving, extended by a flexible member 9 terminating in a distributor means 10 to introduce a flow of liquid $CO_2$ under pressure into the container 2 via the opening 5. The distributor means 10, in this case in the form of a gun in the illustrated example, is preferably suspended by resilient suspension means 11 from an upper frame 12 fixed to an articulated hood structure 13 provided with lateral extensible wings 14 and adapted to be positioned facing the loading surface of the container 1 to form a receptacle for containing cold gases generated during loading of the container 2, which are evacuated to the outside of the work site by an evacuation device 15 comprising a blower. Preferably, the suspension means 11 is displaceable along the upper portion of the framework 12 by a carriage 16 to permit the correct positioning of the gun 10 facing the opening 5 for loading the container 2.

Figure 2:
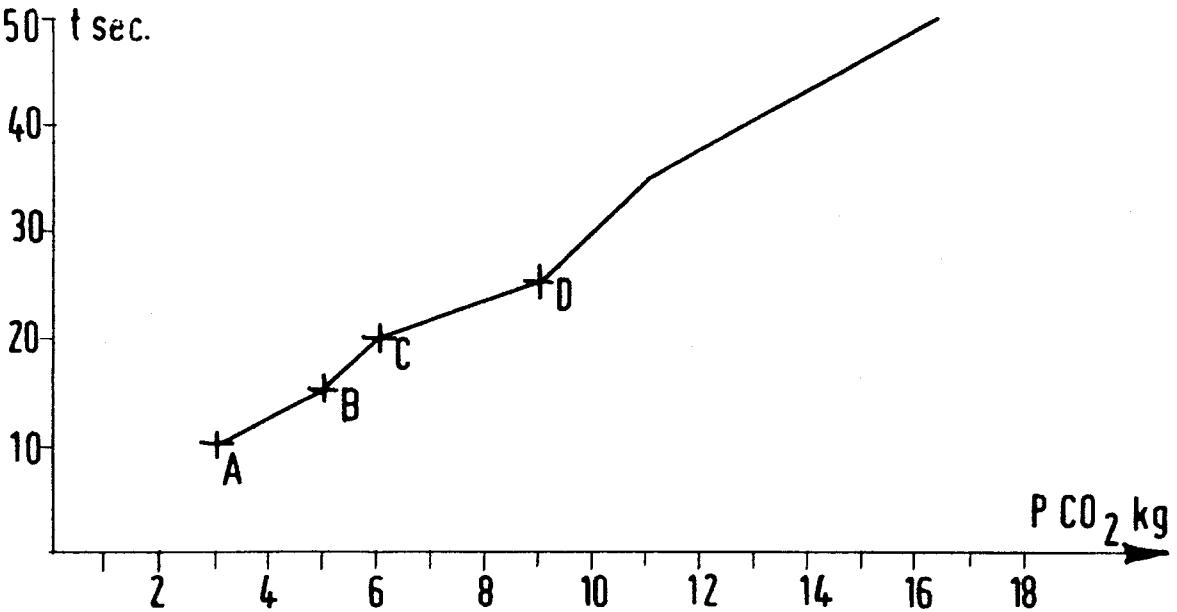
FIG. 2 is a graph illustrating the production of carbon dioxide snow with the process of injection according to the invention.

The gun 10 typically comprises a manual opening/closing valve 17 and, upstream of this latter, an electrovalve 18 connected to a control block 19 mounted on the hood 13. According to one aspect of the invention, the control casing 19 comprises adjustable or preset timing means permitting selecting, as a function of different parameters, the duration of opening of the electrovalve 18, and hence the quantity of liquid $CO_2$ injected into the container 2 and, as a result, the quantities of carbon dioxide snow formed by sublimation within the container. The injection typically takes place such that the liquid $CO_2$ is subjected to at least one impact within the container 2 so as to break up the jet and provoke rapid production and accumulation of carbon dioxide snow within the container. There is shown in FIG. 2 a curve showing the course of formation of carbon dioxide snow within the container 2 as a function of the time of injection of liquid $CO_2$, in seconds. The container 1 and its container 2 being initially at ambient temperature, the quantity of carbon dioxide snow formed up to 10 seconds of injection is not determinable in a reproducible way. The points A to D on the curve represent breaks in the transformation curve of liquid/solid $CO_2$ during injection into the container. At point A, the transformation rate is about 21%. It increases progressively to a value of the order of 35% to point B, from which it remains substantially constant to point C for a new increase to a value slightly greater than 40% at point D to remain substantially constant beyond this point D. It will be seen that a quantity of 5 kg of carbon dioxide snow is generated in less than 20 seconds and that it suffices that there be a duration of injection of 25 seconds to generate a mass of carbon dioxide snow of 10 kg.

As mentioned above, the flexibility of the process according to the invention permits easily adjusting, as a function of predetermined parameters, particularly having regard to the climatic conditions and the foreseen duration of transport, the quantity of carbon dioxide snow generated in the container, as well as to adapt the quantities of carbon dioxide snow to the preservation and transportation of fresh foodstuffs, whose temperature must be comprised between 0° and 4° C., as well as for frozen products, whose temperature must not exceed −15° C.

By way of example, there is shown below a table of standard measured quantities for a container 1 of a usable capacity of about 1200 liters with a container 2 whose surface is just slightly less than the usable horizontal section of the internal chamber 3 of the container:

| | Time of injection of $CO_2$ in seconds | Carbon dioxide snow generated |
|---|---|---|
| FRESH PRODUCTS | | |
| Winter transport | 15 s | 4.88kg |
| Summer transport | 20 s | 5.86kg |
| Weekend transport | 30 s | 9.32kg |
| FROZEN PRODUCTS | | |
| Winter transport | 30 s | 9.32kg |
| Summer transport | 40 s | 12.42kg |
| Weekend transport | 50 s | 15.88kg |

According to one aspect of the invention, the different times of injection can be preset in the casing 19 and are selectable by switches for fresh/frozen; winter/summer; week/weekend. These durations of injection can also be preprogrammed in memories in the casing 19 and accessible by entering codes on a keyboard or by inserting a data card.

Figure 3:
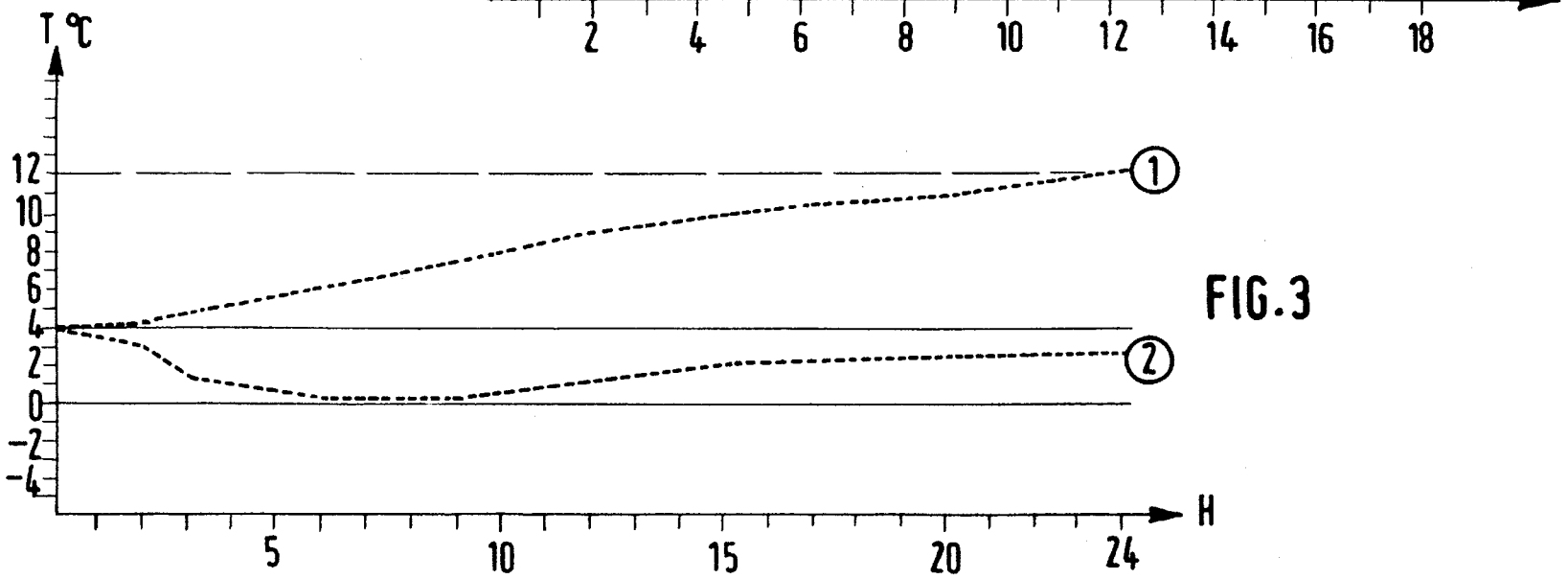
FIG. 3 is a comparative graph showing the change of temperature of fresh products in a chamber charged with carbon dioxide snow according to the invention and a chamber free from carbon dioxide snow.
Figure 6:
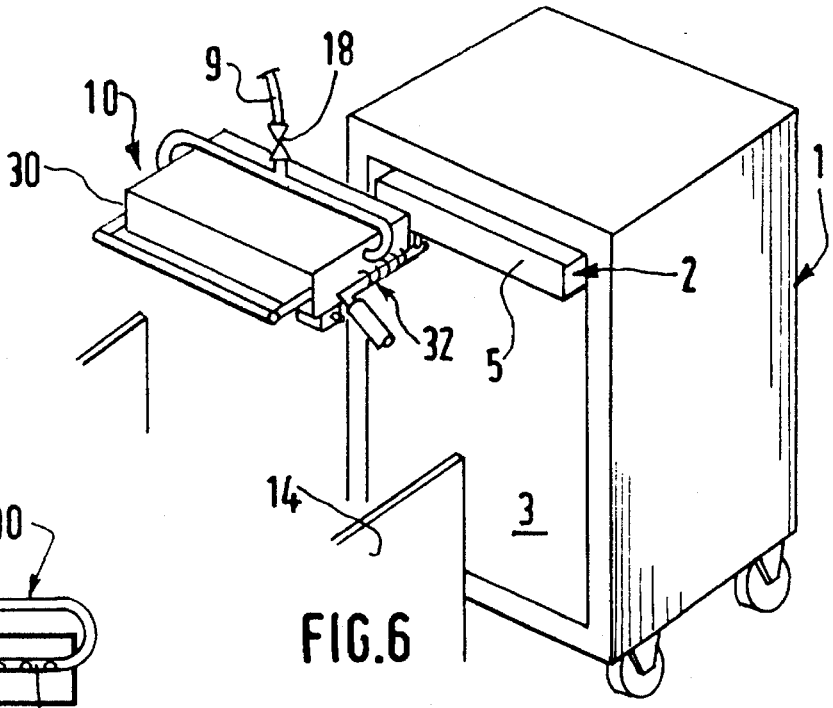
FIG. 6 is a view analogous to FIG. 1 showing another embodiment of the invention.
Figure 7:
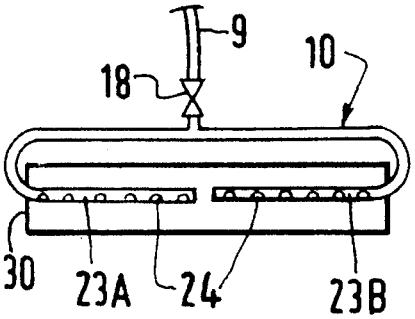
FIG. 7 is a transverse cross-sectional view of the distributor/injector casing of FIG. 6.
Figure 8:
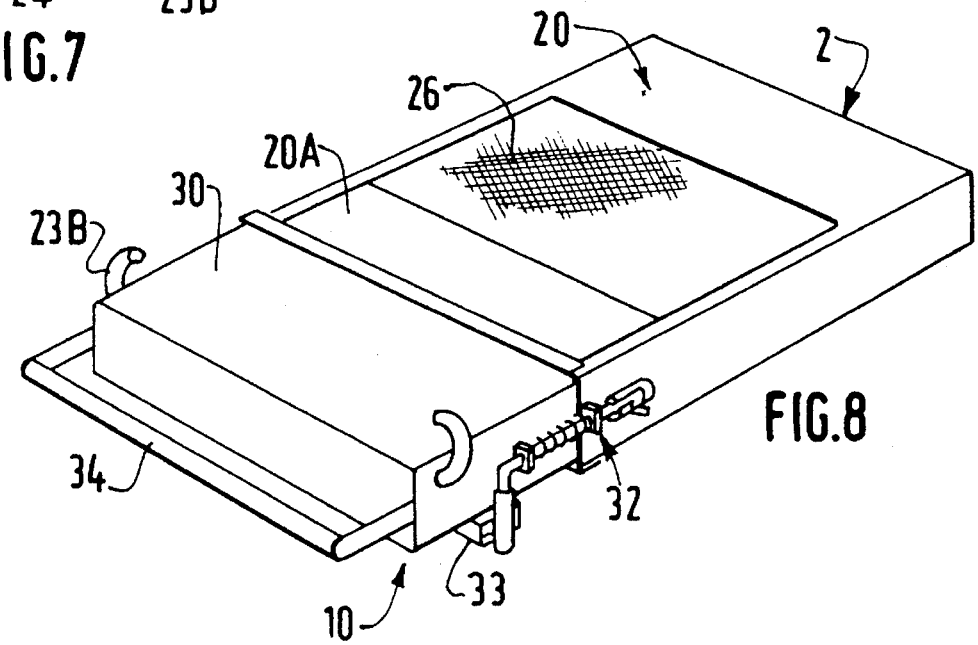
FIG. 8 is a perspective view showing the connection of the casing and the container.

In FIG. 3, there is shown variations of temperature with time for hamburger steak with the process according to the invention (curve 2) and with a process which simply preliminarily cools the product and its container (curve 1).

As mentioned above, the thermal shield 4 is mounted suspended in removable fashion within the upper portion of the container 1 for use in the preservation and transportation of fresh products, this thermal shield being removed in the configuration for the preservation and transport of frozen products less susceptible to the proximity of the very cold surface constituted by the internal surface of container 2.

In the embodiment of FIGS. 4 and 5, the container 2 according to the invention is present in the form of a parallelepipedal housing of sheet metal, typically of stainless steel, with an upper wall 20 and a forward surface 21 traversed, adjacent a lateral wall 22, by a fitting 50. This fitting 50 constitutes a prolongation of an injection manifold 25 extending along the side wall 22 and typically formed, on its side opposite the wall 22, with a series of ejection orifices 24. The manifold 23 supports a deflector profile 25 of L shape, parallel to the manifold. The upper wall 20 of the container 3 comprises a central cutout covered by a grill 26 so as to provide, on opposite sides of the grill 26, a first flat region 20A overlying the manifold assembly of injector 23/deflector 25 and a second symmetrical flat zone 20B.

As will be better seen in FIG. 5, the orifices 24 are oriented so as each to eject a jet of liquid $CO_2$ toward the rear wall of container 2, this jet being deflected by the deflector 25 disposed below the orifices 24, toward the flat portion 20A of the upper wall 20 and from there toward the rear of the housing below the second flat portion 20B, opposite the injection manifold 23, where there progressively accumulates, by sublimation, a mass 27 of carbon dioxide snow, the $CO_2$ vaporized during the formation of this mass 27 escaping, as shown by the broken arrows in FIG. 5, through the grill 26 and filling the internal space 3 of the container 1 to cool this latter, before being evacuated by the hood 23. The container 2 comprises moreover securement tongues 28 for its mounting permanently in the upper portion of the internal volume 3, typically on small vertical posts serving also for the removable mounting of the thermal shield 4 extending below the container 2, at a distance from this latter, when the container 1 is used for the transportation of fresh food products at a temperature comprised between 0° and 4° C.

As will be seen in FIG. 4, the distributor means 10, suspended from the structure 12, is internally shaped to simply fit over the fitting 50, this assembly being locked by a resilient lock 29 manually actuable to unlock the gun and to remove it from the fitting 50. The actuator of valve 17 is moreover mechanically coupled to the lock 29 so as not to permit opening of the valve unless the coupling 10 is correctly applied on the fitting 50 and not to permit such a connection unless the valve is in closed position.

In the embodiment of FIGS. 6 to 9, the container 2 has no front face, thus providing a large access opening 5 for pairing it with a distributor means 10, also suspended from the structure 12 and comprising in this case a parallelepipedal injection casing 30 comprising an open front face and two half injection manifolds 23A, 23B extending transversely within the casing 30, provided with ejection orifices 24 and connected via the electrovalve 18 to the flexible supply member 9.

Figure 9:
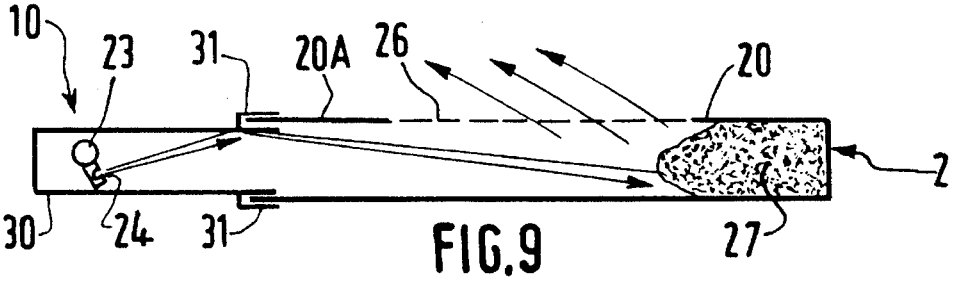
FIG. 9 is a schematic view in longitudinal cross section of the coupled assembly of FIG. 8 showing the path of the fluids during loading of the container.

As will be better seen in FIG. 9, the manifolds 23A, 23B are disposed at the back of casing 30, at a distance from the open front face of the casing whose edges are provided with angles 31 forming a recess to receive the edges of the front surface of container 2 in a coupled position of these two elements locked together by a coupling device 32 constituted, in the illustrated example, by a lock displaceable in rotation and in translation carried by a side surface of the casing 30 and coacting with a conforming cutout formed in a detachable cylinder on the adjacent side surface of container 2. The lock comprises an actuating handle which, in locked position, actuates a contactor 33 mounted on the internal surface of casing 30 and supplying a validation signal to the electronic control block 19. The casing 30 preferably comprises, on its rear face, a handle 34.

As is seen in FIG. 9, the injectors 24 are oriented angularly toward the upper wall of the casing 30 so as to eject jets of liquid $CO_2$ under pressure to come into contact with this upper wall to be deflected, while breaking up the jets of liquid $CO_2$, toward the rear of the container 2 in which the liquid $CO_2$, expanded during its deflected travel, produces finely divided carbon dioxide snow 27 accumulating in corresponding quantity at the rear of container 2, as in the embodiment of FIGS. 4 and 5. As in this latter, the injectors 24 can be oriented downwardly to strike a deflector returning the jets toward the upper wall of the casing. At the end of a predetermined injection time, an end-of-cycle light is illuminated on the block 19 and the operator can then detach the casing 30 from the container 2.

Although the invention has been described with relation to a particular embodiment, it is not thereby limited but on the contrary is susceptible of modifications and variations which will be apparent to one skilled in the art.

We claim:

1. A dry ice holder for use in a thermally insulated container, said dry ice holder comprising a generally parallelepipedic configuration having a front face, a first side wall adjacent the front face, a bottom wall, an apertured upper wall, an injector disposed in the holder, adjacent the first side wall and having at least one injection orifice oriented in a direction away from the side wall, and a connecting means extending outwardly from the front face for releasable connection to a line for supplying liquid $CO_2$.

2. The holder of claim 1, further comprising a deflector arranged adjacent the orifice to deflect a jet injected by the orifice.

3. The holder of claim 2, wherein the injector and the deflector are elongated and extend substantially parallel to the first side wall.

4. The holder of claim 2, wherein the upper wall comprises a first plane part covering the injector and the deflector, the orifice being directed toward the bottom wall and the deflector arranged so as to deflect a jet injected by the orifice toward the first plane part of the upper wall.

5. The holder of claim 4, further comprising a second side wall opposite the first side wall and wherein the upper wall comprises a second plane part adjacent the second side wall.

6. The holder of claim 5, wherein the upper wall comprises a grid part between the first and second plane parts.

7. A thermally insulated container comprising a dry ice holder of a generally parallelepipedic configuration having a front face, a first side wall adjacent to the front face, a bottom wall, an apertured upper wall, an injector disposed in the holder, adjacent the first side wall and having at least one injection orifice oriented in a direction away from the side wall, a connecting means extending outwardly from the front face for releasable connection to a line for supplying liquid $CO_2$, said container defining an inner space divided by a partition wall into a lower space, for storing goods, and an upper space of reduced volume wherein the dry ice holder is arranged.

8. The container of claim 7, wherein the upper and lower spaces are accessible by a common side face, the front face of the holder arranged adjacent the side face.

9. The container of claim 8, wherein the partition wall is releasably mounted in the inner space.

* * * * *